US009776022B2

(12) United States Patent
Grilliot et al.

(10) Patent No.: US 9,776,022 B2
(45) Date of Patent: Oct. 3, 2017

(54) PROTECTIVE GARMENT USABLE WITH GAS TANK RELEASIBLY CARRIED BY SHOULDER STRAPS AND WAIST BELT

(75) Inventors: William Grilliot, West Milton, OH (US); Thomas Stachler, Brookville, OH (US); Mary Grilliot, West Milton, OH (US)

(73) Assignee: Honeywell International Inc., Morristown, NJ (US)

( * ) Notice: Subject to any disclaimer, the term of this patent is extended or adjusted under 35 U.S.C. 154(b) by 1083 days.

(21) Appl. No.: 12/427,871

(22) Filed: Apr. 22, 2009

(65) Prior Publication Data

US 2009/0229603 A1 Sep. 17, 2009

Related U.S. Application Data

(63) Continuation of application No. 12/075,687, filed on Mar. 13, 2008, now abandoned, and a continuation-in-part of application No. 12/242,262, filed on Sep. 30, 2008, now Pat. No. 8,316,850.

(51) Int. Cl.

| | |
|---|---|
| ***A62B 7/02*** | (2006.01) |
| ***A62B 17/00*** | (2006.01) |
| ***A62B 9/04*** | (2006.01) |
| ***A41D 13/00*** | (2006.01) |
| ***A62B 7/00*** | (2006.01) |

(52) U.S. Cl.

CPC ..... *A62B 7/02* (2013.01); *A41D 13/0007* (2013.01); *A62B 7/00* (2013.01); *A62B 9/04* (2013.01); *A62B 17/00* (2013.01); *A62B 17/003* (2013.01)

(58) Field of Classification Search

CPC . A61M 16/06; A62B 7/00; A62B 7/02; A62B 7/06; A62B 7/12; A62B 7/14; A62B 9/04; A62B 17/00; A62B 17/001; A62B 17/003; A62B 17/006; A62B 17/008; A62B 18/00; A62B 18/006; A41D 13/0007

USPC ..... 128/202.13, 202.19, 201.29, 205.22, 128/200.24, 200.28, 201.22, 201.23, 128/204.18, 205.15, 205.25, 202.11; 2/81, 93, 94, 97, 101, 456, 458; 601/148, 601/151, 43, 44

See application file for complete search history.

(56) References Cited

U.S. PATENT DOCUMENTS

| | | | | |
|---|---|---|---|---|
| 3,174,129 | A * | 3/1965 | Laughlin et al. | 367/132 |
| 3,266,489 | A * | 8/1966 | Williams | 128/202.19 |
| 4,090,509 | A * | 5/1978 | Smith | 128/202.19 |
| 4,404,969 | A * | 9/1983 | Cresswell et al. | 128/201.23 |
| 4,791,921 | A * | 12/1988 | Robison | 128/201.27 |
| 5,188,267 | A * | 2/1993 | Sargent et al. | 2/95 |
| 5,370,113 | A * | 12/1994 | Parsons | 128/205.22 |
| 5,572,991 | A * | 11/1996 | Grilliot et al. | 128/201.29 |
| 5,626,556 | A * | 5/1997 | Tobler et al. | 601/151 |
| 5,887,585 | A * | 3/1999 | Dusenbery | 128/202.14 |
| 6,401,715 | B1 * | 6/2002 | Luthe | 128/205.28 |
| 6,477,709 | B1 * | 11/2002 | Kawana | 2/2.15 |

(Continued)

*Primary Examiner* — Justine Yu
*Assistant Examiner* — Colin W Stuart
(74) *Attorney, Agent, or Firm* — Wood, Phillips, Katz, Clark & Mortimer

(57) ABSTRACT

A system is provided for a firefighter or other emergency worker and includes a protective coat and a self-contained breathing apparatus. The self-contained breathing apparatus includes a regulator connected by a high-pressure hose to a gas tank that is releasibly carried on the coat by shoulder straps and waist straps.

20 Claims, 6 Drawing Sheets

(56) References Cited

U.S. PATENT DOCUMENTS

| | | | | |
|---|---|---|---|---|
| 6,513,523 | B1 * | 2/2003 | Izuchukwu et al. | 128/202.19 |
| 7,062,790 | B2 * | 6/2006 | Rockwell | 2/102 |
| 2002/0153009 | A1 * | 10/2002 | Chornyj | 128/201.27 |
| 2005/0235393 | A1 * | 10/2005 | Rockwell | 2/108 |
| 2006/0096593 | A1 * | 5/2006 | Grilliot et al. | 128/201.29 |
| 2006/0195962 | A1 * | 9/2006 | Jordan | 2/69 |
| 2007/0235030 | A1 * | 10/2007 | Teetzel et al. | 128/205.12 |
| 2009/0064389 | A1 * | 3/2009 | Putman | 2/69 |
| 2009/0077709 | A1 * | 3/2009 | Waters et al. | 2/82 |
| 2009/0077725 | A1 * | 3/2009 | Waters et al. | 2/458 |
| 2009/0217927 | A1 * | 9/2009 | Stood et al. | 128/202.14 |
| 2009/0229613 | A1 * | 9/2009 | Grilliot et al. | 128/205.22 |
| 2011/0197891 | A1 * | 8/2011 | Sanders | 128/205.22 |
| 2012/0060267 | A1 * | 3/2012 | Blenkarn et al. | 2/456 |

* cited by examiner

PROTECTIVE GARMENT USABLE WITH GAS TANK RELEASIBLY CARRIED BY SHOULDER STRAPS AND WAIST BELT

CROSS-REFERENCE TO RELATED APPLICATION

This application is a C-I-P of two prior applications: U.S. application Ser. No. 12/075,687 filed Mar. 13, 2008 entitled "Protective Garment Adapted for Self-Contained Breathing Apparatus" and U.S. application Ser. No. 12/242,262 filed Sep. 30, 2008 entitled "Breathing Apparatus with Sensor", both incorporated herein by reference.

FIELD OF THE INVENTION

The invention relates to protective garments worn by firefighters and other emergency workers and to self-contained breathing apparatus (SCBA) that are used by firefighters and other emergency workers.

BACKGROUND OF THE INVENTION

It is common for firefighters and other emergency workers to wear a self-contained breathing apparatus (SCBA) which has a cylindrical air tank that is carried on the back of a firefighter by a framework, a harness that will typically include shoulder straps, and a waist strap worn over the coat of their turnout gear. Such tanks are disadvantageous in that being cylindrical, they protrude from the back of the user.

DETAILED DESCRIPTION

Figure 1A:
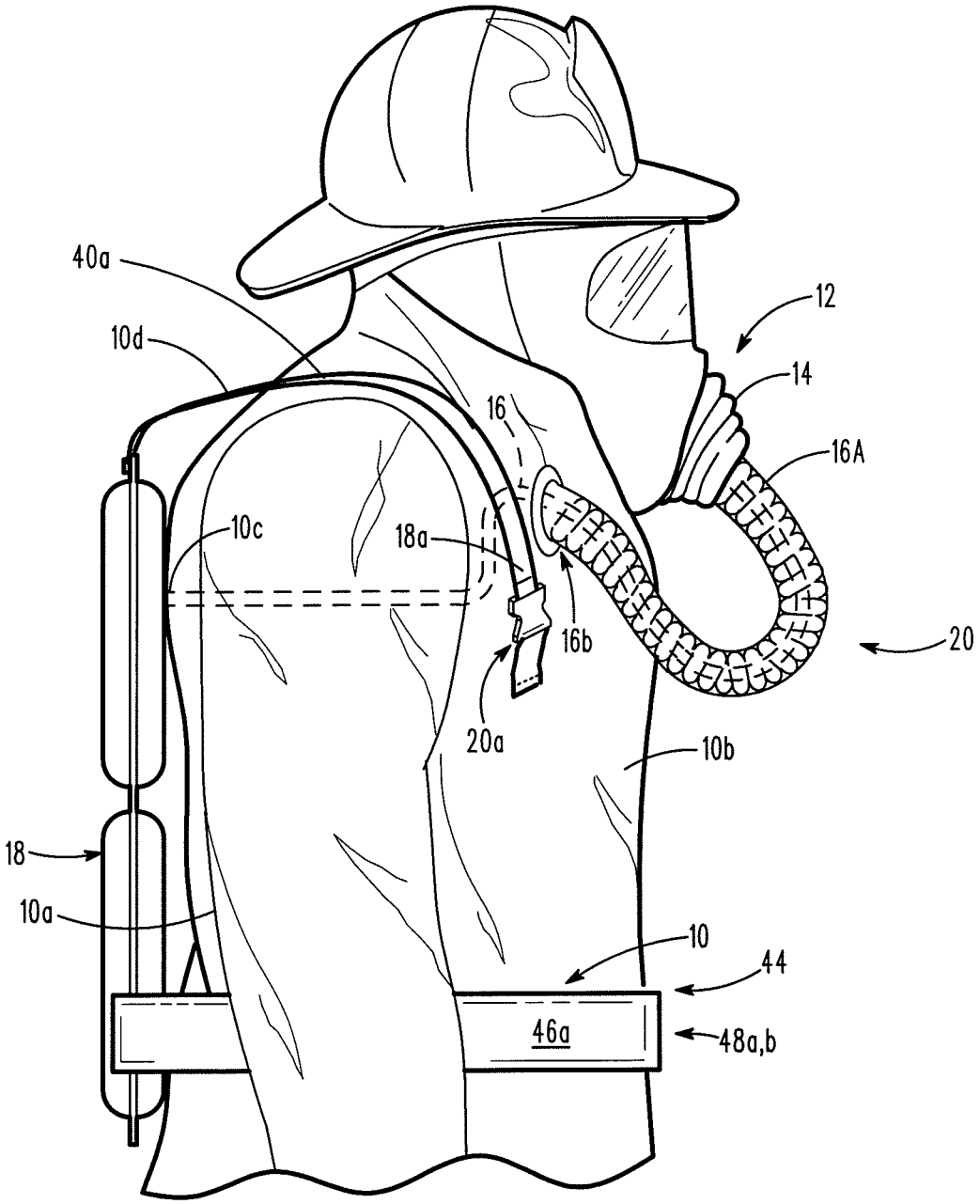
FIG. 1A is a perspective view from the side of a fireman or other emergency worker wearing a protective coat and SCBA system embodying the present invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

In accordance with one embodiment of the invention, a protective coat and self-contained breathing apparatus system is provided for a firefighter or other emergency worker. The system includes an oxygen/air tank, a regulator, a high pressure hose connected to the tank and the regulator to provide a flow of oxygen/air from the tank to the regulator, and a garment having an outer shell having a torso covering with a back and a front, a pair of sleeves extending from the torso covering portion, and a releasible harness carrying the oxygen/air tank. The harness releasibly engages the outer shell.

With reference to FIG. 1A, a firefighter or other emergency worker is shown wearing a protective garment in the form of a protective coat 10, and a self-contained breathing apparatus (SCBA) 12 that includes a regulator 14 connected by a high pressure hose 16 to an oxygen/air tank system 18 that is releasibly carried on the back of the firefighter by the coat 10. The tank 18 is located adjacent to a rear surface 10*a* of the coat 10.

Together, the coat 10 and the SCBA 12 form a system 20 that allows a firefighter or other emergency worker to perform in hazardous environments. Except as described herein, the coat 10 may be substantially similar to prior garments and coats designed for firefighters and rescue workers, such as those manufactured and sold by Morning Pride Manufacturing, Inc. of Dayton, Ohio.

Figure 1B:
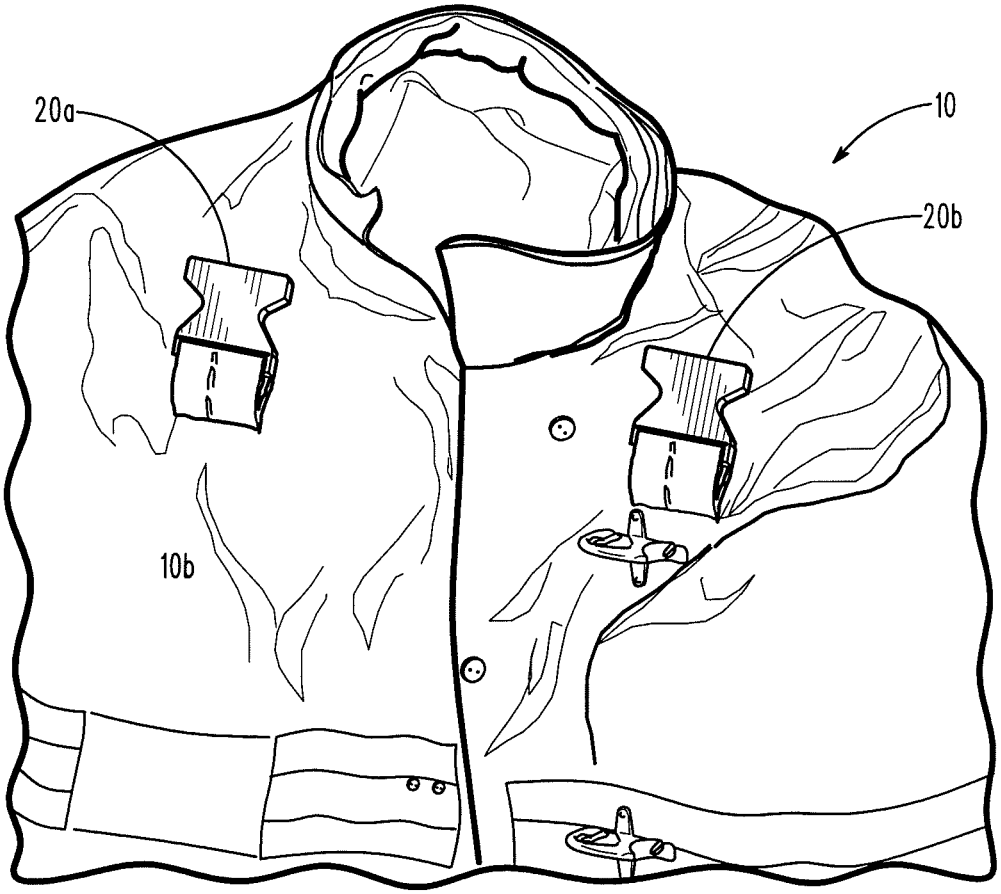
FIG. 1B is a fragmentary front elevational view of releasible connectors carried on the coat of FIG. 1.

FIG. 1B is a frontal view illustrating a pair of quick release connector elements 20*a* and 20*b* which releasibly engage mating connector elements 18*a, b* carried by tank 18. Connector elements 20*a, b* are carried on a front surface of 10*b* of coat 10. Snaplocks, twist locks, snaps or other types of two-part quick release connectors, such as hook and eye, VELCRO brand, connectors can be used and come within the spirit and scope of the invention.

Figure 3:
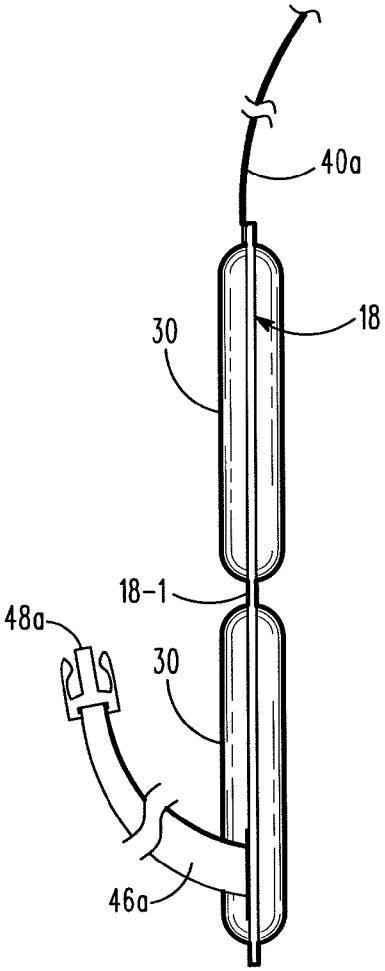
FIG. 3 is a side view of the oxygen/air tank of FIG. 2.
Figure 2:
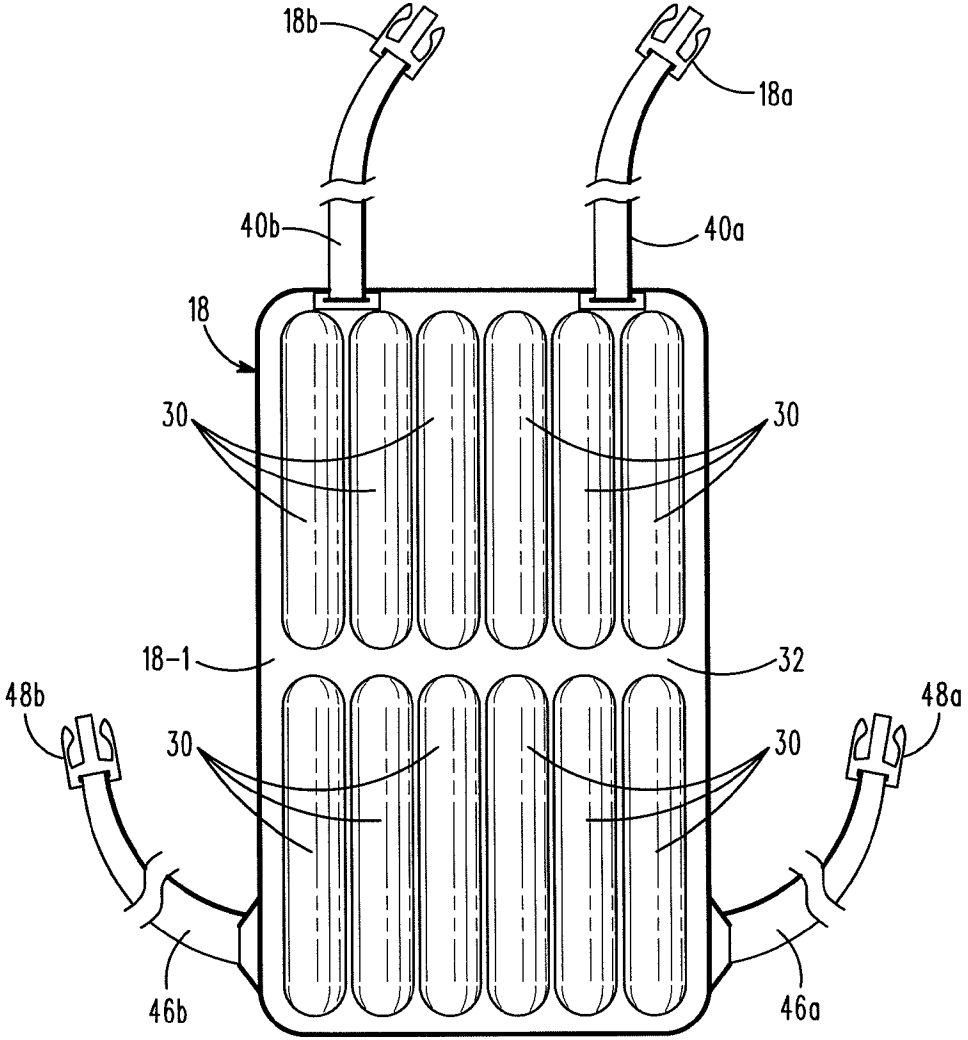
FIG. 2 is an elevation view of an oxygen/air tank of the SCBA of FIG. 1.

As best seen in FIGS. 2 and 3, the tank system 18 preferably has a lower profile, with a flattened cross-section in comparison to the more conventional cylindrical oxygen/air tanks. In the illustrated embodiment, the tank system 18 has two rows of interconnected, vertically extending, semi-cylindrical oxygen/air compartments or bladders 30 arranged on a substrate 18-1 which could include with a somewhat flexible "hinge" portion 32 that allows the tank to partially conform to and/or bend with the wearer's body. It should be appreciated that while a particular embodiment of the tank system 18 is shown, in some applications it will be desirable use other configurations of tank system 18.

In FIG. 1A a low pressure hose or line 16*a* extends from an exhalation valve in the regulator 14 to the inside of the coat 10 via the port 16*b* to direct expelled air from the regulator 14 to the inside of the coat 10 and create a positive pressure therein. As illustrated, the high pressure hose 16 extends inside of the low pressure hose 16*a* from the coat 10 to the regulator 14. This provides a system 20 wherein there is only one SCBA line or hose exposed on the exterior of the coat 10. A port 10*c* is provided on the rear 10*a* of coat 10 through which high pressure hose 16 extends through and couples to tank 18.

The tank system 18 is carried on a substrate 18-1. The bladders 30 are arranged on and carried by the substrate 18-1. Additionally, the substrate 18-1 has connected thereto shoulder straps 40*a, b*. The shoulder straps 40*a, b* terminate in the connector elements 18*a, b*.

Figure 4A:
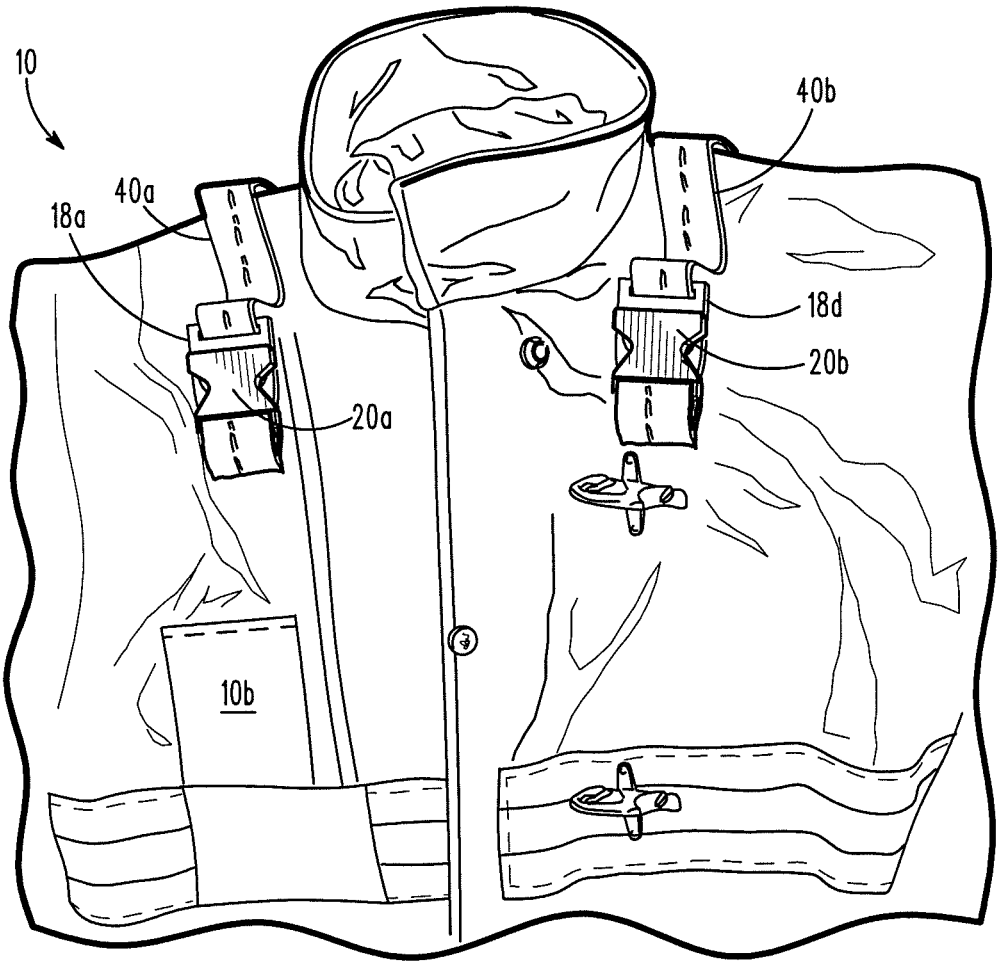
FIG. 4A is a partial front view of the coat of FIG. 1 illustrating engagement of the tank of FIG. 2.
Figure 4B:
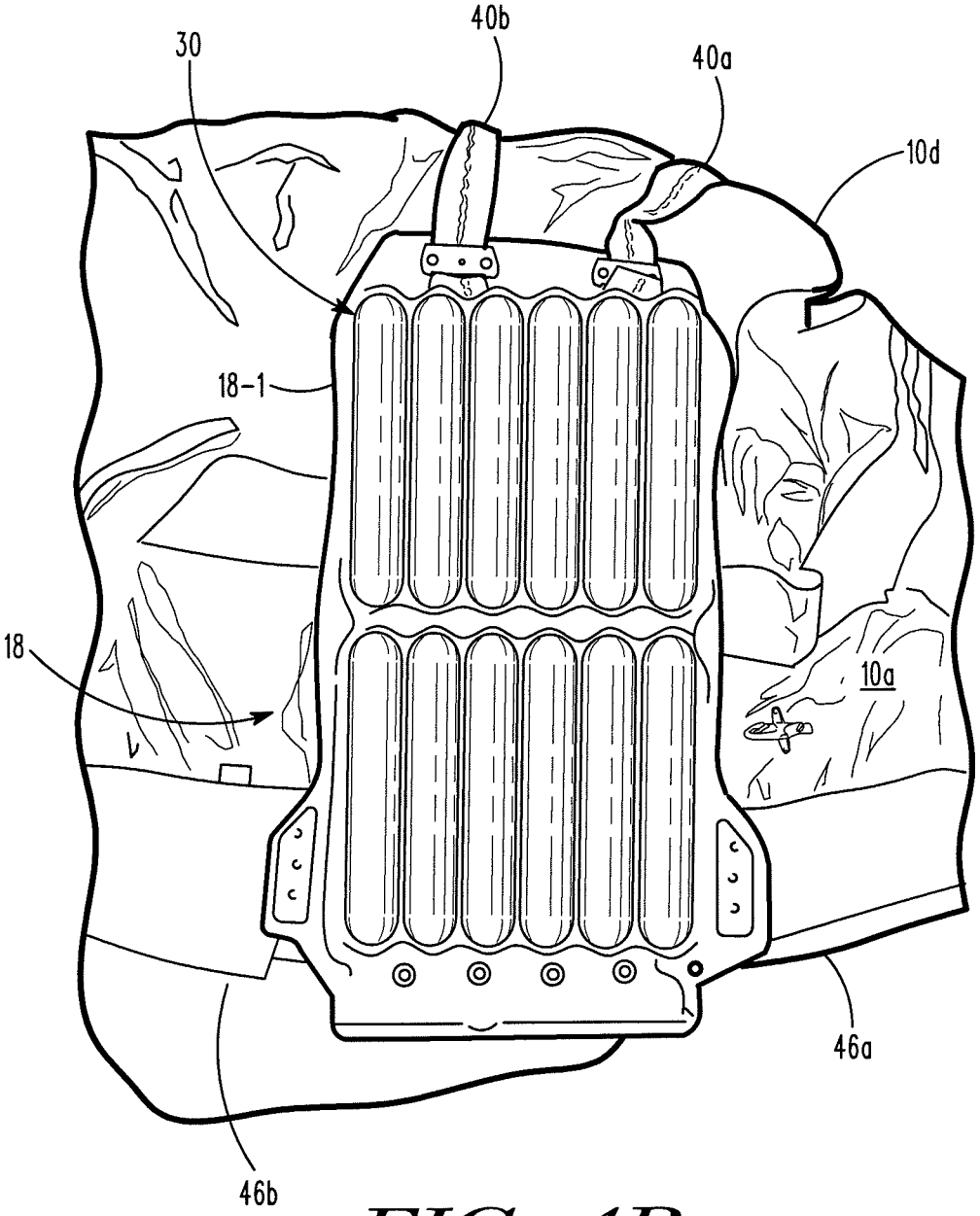
FIG. 4B is a view of a coat as in FIG. 1 illustrating further details of the engagement of the tank of FIG. 2 with a coat as in FIGS. 1A, 1B.

As illustrated in FIGS. 4A, 4B the shoulder straps 40*a, b* are releasibly coupled to the coat 10 via connector elements 20*a, b* which are fixedly attached thereto. The substrate 18-1 also carries a waist belt indicated generally at 44 of FIG. 1. The waist belt of 44 has first and second flexible belt portions 46*a* and 46*b* each of which terminate in a pair of mating connector elements 48*a, b*.

The connection of the two elements 46*a*, 46*b* around the waist of the first responder on the coat 10 in combination with the elements 40*a, b* which extend over the first responder's shoulder region 10*d* provide a secure and comfortable connection of the tank system 18 to the first responder's coat 10.

FIG. 4B illustrates the tank system 18 being carried with the shoulder straps of 40*a, b* and the waist straps 46*a, b* by a first responder or firefighter. This configuration provides a relatively flat secure coupling for the tank system 18 adjacent to the back 10*a* of the firefighter's coat 10.

Figure 5B:
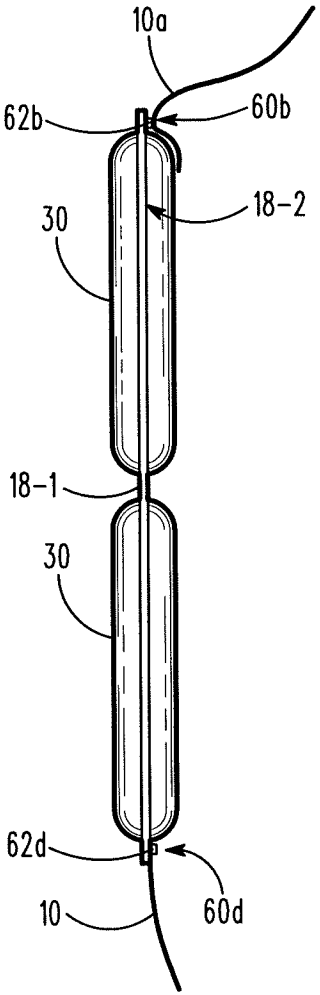
Figure 5A:
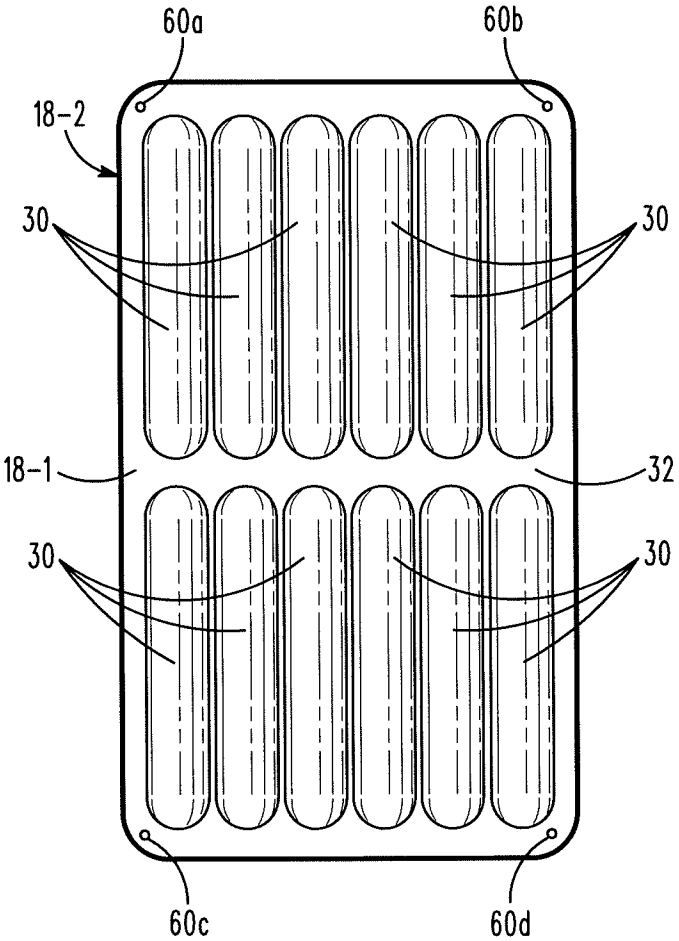

FIGS. 5A, B illustrate front and side views of a variation 18-2 of the tank system. The system 18-2 carries a plurality of snaps or plastic engaging, hook and eye, fastening elements, such as the VELCRO Brand-type fasteners, 60*a, b, c, d*. The exact number and location are not limitations of the invention. In this embodiment, the fasteners 60*i* releasibly engage matching fasteners, such as 62*a, b, c, d* carried on a rear surface of 10*a* of the protective garment or coat 10. If desired, this embodiment could also include one or more of straps 40, 46 in addition to the fasteners 60*i*.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A system comprising:

an oxygen/air tank system;

a regulator;

a high pressure hose connected to the tank system and the regulator to provide a flow of oxygen/air from the tank system to the regulator;

an outer shell of a protective garment having a torso covering portion with a back and a front, with a pair of ports including a back port extending through the back of the torso covering portion and front port extending through the front of the torso covering portion, a pair of sleeves extending from the torso covering portion, wherein the high pressure hose extends through the front and back ports of the shell in a generally stationary position from outside the back of the torso covering portion through the back port into an interior portion of the shell and through the front port to outside the front of the torso covering portion;

an exhalation valve of the regulator;

an exhaust hose that directs expelled air from the exhalation valve of the regulator to an inside of the protective garment through the front port to create a positive pressure therein wherein the high pressure hose extends inside the exhaust hose from the regulator to the front of the torso covering portion, through the front port across the inside of the torso covering portion and out the back of the torso covering portion through the back port; and first and second connector elements, carried spaced apart on the outer shell, releasibly couplable to the tank system.

2. The system of claim 1 wherein the high pressure hose extends through openings in the front and back of the outer shell.

3. The system of claim 1 wherein the tank system has a flattened cross-section.

4. The system of claim 1 where the tank system carries first and second spaced apart shoulder straps.

5. The system of claim 4 where the tank system carries at least one waist strap.

6. The system of claim 5 where the shoulder straps and at least one waist strap each have a free end with the ends each carrying a releasible connector element.

7. The system of claim 6 where the connector elements are selected from a class which includes linearly engagable connector elements, rotatably engagable connector elements, or overlappingly engagable connector elements.

8. The system of claim 6 where the linearly engagable connector elements comprise snap-lock type connectors.

9. The system of claim 5 where the tank system carries first and second releasibly engagable waist straps.

10. The system of claim 9 where the waist straps each have a free end which carries a waist connector element when the waist connector elements releasibly engage one another.

11. A protective coat for use with a self-contained breathing apparatus system for a firefighter or other emergency worker, the coat comprising:

an outer shell of the protective coat having a torso covering portion with a back and a front;

a pair of sleeves extending from the torso covering portion; and first and second releasible connector elements fixed to the outer shell and adapted to releasibly carry an oxygen/air tank system of the self-contained breathing apparatus system;

an opening at the back of the torso covering portion, the opening extending between a back exterior surface of the outer shell and an interior portion of the outer shell;

a high pressure hose, the opening allowing passage of the high pressure hose of the self-contained breathing apparatus system between the oxygen/air tank system and an inside of the torso covering portion;

a port in the front of the outer shell, the port extending between the interior portion and a front exterior surface of the outer shell;

a low pressure hose connected between the port on the front of the outer shell and an exhalation valve of a regulator, the low pressure hose directs expelled air from the exhalation valve of the regulator of the self-contained breathing apparatus system to an inside of the protective coat, the expelled air creating a positive pressure inside of the protective coat, the low pressure hose and port also allowing the high pressure hose to pass completely through the low pressure hose and protective coat entering through the opening at the back, through the interior portion of the outer shell, through the port on the front of the outer shell and through the low pressure hose and connecting with the regulator of the self-contained breathing apparatus system.

12. The coat of claim 11 where the low pressure hose surrounds the high pressure hose.

13. The coat of claim 11 where the first and second releasible connector elements are selected from a class which includes linearly engagable connector elements, rotatably engagable connector elements, or overlappingly engagable connector elements.

14. A coat as in claim 11 which supports the tank system on first and second upper shoulder surfaces and where the tank system carries first and second shoulder straps which overlay respective shoulder surfaces and which releasibly engage the first and second releasible connector elements.

15. A coat as in claim 14 where the first and second releasible connector elements are selected from a class which includes linearly engagable connector elements, rotatably engagable connector elements, or overlappingly engagable connector elements.

16. A system comprising:

a low profile oxygen/air tank system having a generally planar flexible substrate, first and second spaced apart shoulder straps extending from an end of the substrate, at least one waist strap extending from a side of the substrate, and a plurality of interconnected oxygen/air compartments embedded on the substrate, the plurality of compartments extending along a length of the substrate such that the substrate generally bisects the plurality of compartments in cross section, the first and second shoulder straps and the at least one waist strap having releasable connector elements thereon;

an outer shell of a protective garment having a torso covering portion with a back and a front, a pair of sleeves extending from the torso covering portion, a back port extending through the back of the outer shell and a front port extending through the front of the outer shell and first and second connector elements spaced apart on the front of the outer shell, the first and second connector elements suitable for releasably engaging the connector elements of the shoulder straps;

a regulator;

a high pressure hose connecting the tank system and the regulator to provide a flow of oxygen/air from the tank system to the regulator, the high pressure hose extending from outside the back of the torso covering portion through an opening of the back port in the back of the outer shell, across an interior portion of the outer shell, the high pressure hose extending from the interior portion of the outer shell to outside the front of the torso covering portion through the front port at the front of the shell, the high pressure hose extending through the outer shell in a generally stationary position; and a low pressure hose extending from an exhalation valve of the regulator to the interior portion of the protective garment, the low pressure hose extending through the front port in the front of the torso covering portion, the low pressure hose carrying expelled air from the regulator to inside of the protective garment, the low pressure hose surrounding the high pressure hose between the regulator and the interior portion at the front of the shell wherein the expelled air carried by the low pressure hose from the regulator to the interior portion of the protective garment creates a positive pressure inside of the protective garment.

17. The system of claim 16 wherein the plurality of oxygen/air compartments are semi-cylindrical and arranged generally vertically on the substrate in two rows.

18. The system of claim 16 wherein the substrate has a flexible hinge portion.

19. The system of claim 16 wherein connector elements are snap-lock type connectors.

20. The system of claim 16 wherein the opening at the back of the torso covering portion is a port.

* * * * *